US010766502B2

(12) United States Patent
Roodenburg et al.

(10) Patent No.: US 10,766,502 B2
(45) Date of Patent: Sep. 8, 2020

(54) AMUSEMENT RIDE WITH BOOSTER DRIVES

(71) Applicant: VEKOMA RIDES ENGINEERING B.V., Vlodrop (NL)

(72) Inventors: Hendrik Ficus Roodenburg, Krimpen Aan Den Ijssel (NL); Mattheus Hendrik Louis Thissen, Swalmen (NL); Koen Janssen, Dilsen-Stokkem (BE); Petrus Henricus Josephus Van Oosterhout, Herkenbosch (NL)

(73) Assignee: VEKOMA RIDES ENGINEERING B.V., Vlodrop (NL)

( * ) Notice: Subject to any disclaimer, the term of this patent is extended or adjusted under 35 U.S.C. 154(b) by 282 days.

(21) Appl. No.: 15/563,862

(22) PCT Filed: Apr. 1, 2016

(86) PCT No.: PCT/NL2016/050227

§ 371 (c)(1),
(2) Date: Oct. 2, 2017

(87) PCT Pub. No.: WO2016/159772

PCT Pub. Date: Oct. 6, 2016

(65) Prior Publication Data

US 2018/0072328 A1 Mar. 15, 2018

(30) Foreign Application Priority Data

Apr. 3, 2015 (NL) ..... 2014583

(51) Int. Cl.
*B61B 13/12* (2006.01)
*A63G 7/00* (2006.01)

(52) U.S. Cl.
CPC ..... *B61B 13/127* (2013.01); *A63G 7/00* (2013.01)

(58) Field of Classification Search
CPC ..... B61B 13/12; B61B 13/122; B61B 13/125; B61B 13/127; A63G 7/00
See application file for complete search history.

(56) References Cited

U.S. PATENT DOCUMENTS 4,361,094 A * 11/1982 Schwarzkopf ..... A63G 7/00 104/168
5,421,267 A * 6/1995 Mesko ..... B61B 13/127 104/168

(Continued)

OTHER PUBLICATIONS

Dutch Search Report, issued in priority application No. 2014583, dated Nov. 24, 2015.

(Continued)

*Primary Examiner* — Jason C Smith
(74) *Attorney, Agent, or Firm* — Birch, Stewart, Kolasch & Birch, LLP

(57) ABSTRACT

An amusement ride such as a roller coaster, more in particular to booster drives mounted on a track of such a ride, are disclosed. The booster drives each include at least one booster drive motor for driving booster wheels, and for engaging a drive fin of a passenger vehicle to propel that vehicle along the track. The booster drive further includes a base mounted to the track structure, a frame that supports the at least one booster drive motor and the two booster wheels, and a mobile carrier that connects the frame to the base via a left and a right carrier arm. These carrier arms are non-flexible arms pivotably connected to the base and the frame or they are flexible arms, such that in use they enable movement of the frame relative to the base. A biasing device resiliently forces the frame towards a predetermined position.

19 Claims, 5 Drawing Sheets

(56) References Cited

U.S. PATENT DOCUMENTS

| | | | | | |
|---|---|---|---|---|---|
| 5,463,962 | A * | 11/1995 | Gnezdilov | A63G 7/00 | 104/53 |
| 5,595,121 | A * | 1/1997 | Elliott | A63G 7/00 | 104/288 |
| 5,647,281 | A * | 7/1997 | Kunczynski | B61B 13/127 | 104/119 |
| 6,595,141 | B2 * | 7/2003 | Ishikawa | B61B 13/00 | 104/163 |
| 2018/0072328 | A1 * | 3/2018 | Roodenburg | B61B 13/127 | |

OTHER PUBLICATIONS

International Search Report, issued in PCT/NL2016/050227, dated Sep. 1, 2016.
Written Opinion of the International Searching Authority, issued in PCT/NL2016/050227, dated Sep. 1, 2016.

* cited by examiner

AMUSEMENT RIDE WITH BOOSTER DRIVES

FIELD AND BACKGROUND OF THE INVENTION

The present invention relates to an amusement ride, such as a roller coaster, comprising a vehicle track configured for guiding a passenger vehicle along that vehicle track. More in particular, the invention relates to a booster drive for displacing a vehicle along the vehicle track of an amusement ride.

Amusement rides, such as coaster rides, are known in the art. They comprise a rail type vehicle track that defines a support surface for supporting a passenger vehicle, and that guides the passenger vehicle along that vehicle track. The vehicle track is designed to provide passengers with a thrill by guiding the passenger vehicles at high speeds along a curved vehicle track. Thrills are for example achieved by providing the track with steep drops, high-speed turns, loopings, etc.

The passenger vehicles of this type of amusement rides typically are not self powered vehicles. Traditionally, a lift hill is provided at the beginning of the track. The passenger vehicle is pulled onto the lift hill and is subsequently propelled down the lift hill by gravity, thus obtaining a speed sufficient to complete the track.

In more recent designs, booster drives have been provided along the track to provide the passenger vehicles with additional speed while traveling along the track. The booster drives are provided with booster wheels configured to engage a longitudinal drive fin provided at the bottom side of the passenger vehicles, and to propel that drive fin, and thus the passenger vehicle, along the track. The booster drives are mounted along the track such that the drive fin of a passing passenger vehicle is engaged by the booster wheels, more in particular is pinched between the booster wheels, each wheel engaging one of the contact surfaces of the drive fin.

The drive fin is a longitudinal beam or plate that is provided at the underside of the passenger vehicle. The drive fin is on opposite sides provided with contact surfaces. It extends in the direction of travel, typically the longitudinal direction, of the vehicle. To enable the booster drives to propel the passenger vehicle forward, a drive fin of considerable length and stiffness is needed.

The booster drives have two booster wheels that are positioned to pinch the drive fin of a passing vehicle between them. By driving one or both of the wheels, the booster drive pushes the drive fin in the direction of travel of the vehicle, and thus propels the passenger vehicle further along the track. Providing booster drives along the track thus enables to propel passenger vehicles while traveling along the track. Therefore, the lift hill at the beginning of the track can be reduced in size and/or the track can be extended. Furthermore, by using booster drives increased speeds can be achieved along the track.

With the known booster drives, speed control along the track is however still limited. To correctly engage the drive fin, the booster drives need to be exactly positioned in the track. Furthermore, to correctly propel the drive fin along the track, the booster wheels need to stay correctly positioned relative to the drive fin of the passing vehicle. If only one of the booster wheels engages the drive fin, insufficient force can be transferred from the booster drive to the vehicle. Typically, the drive fin is located at the center of the vehicle and the booster drives are provided at the center of the track.

Because the drive fin is a long and straight element, it will not follow the curvature of a track. Thus, when the vehicle travels along a curved section of the track, the position of the drive fin relative to a booster drive fixed at the center of the track will change, which prevents the booster wheels from a constant engagement with the drive fin. Therefore, the use of booster drives is restricted to straight sections of the roller coaster track. This limits the control over the speed of the vehicle along the vehicle track, which typically comprises many curved sections, and thus limits the level of thrill that can be provided to the passengers of the vehicle.

In U.S. Pat. No. 4,361,094 it has been suggested to provide the passenger vehicles of coaster type rides with a flexible drive fin. By allowing the drive fin to move in a lateral direction, the position of the booster drives relative to the track is less critical. Furthermore, the flexible drive fin allows for booster drives to be located along curved sections of the vehicle track. However, a drawback of the disclosed flexible drive fin is that its flexibility does not allow for optimal transfer of the drive force between booster and passenger vehicle.

It is an object of the present invention to provide an alternative amusement ride, more in particular to provide an amusement ride with improved booster drives. Another object of the invention is to provide an improved booster drive for use in such amusement rides. Another object is to provide a booster drive that can be used with traditional drive fins along straight as well as curved trajectories of a track.

SUMMARY OF THE INVENTION

According to the invention, this object is achieved by an amusement ride and by a booster drive, adapted to be mounted on a vehicle track.

An amusement ride according to the invention comprises a vehicle track, at least one passenger vehicle, and multiple booster drives.

The vehicle track comprises a vehicle track structure that defines a support surface for supporting the passenger vehicle and that is configured for guiding the passenger vehicle along the vehicle track. The vehicle track can be a typical roller coaster track, comprising a vehicle track structure comprising a base or backbone, a pair of load bearing rails for engagement by the passenger vehicle, and cross members connecting the load bearing rails with the back bone. In an alternative embodiment, the track can for example be rails supported on a concrete base, or a channel shaped concrete body of which the bottom supports the passenger vehicle and the sides guiding the vehicle. Other suitable types of tracks can also be used.

Typically, amusement rides such as roller coasters are provided with a closed loop track having a single location for loading and unloading passengers. However, a linear type of track, in which the vehicle drives back and forth between opposite ends of the track, can also be used. Furthermore, the track can be provided with one or more storage sections for storage of passenger vehicles not being used, for maintenance, etc. Also, the track can comprise a single route, be for example a loop shaped, or multiple routes, such that the route the passenger vehicles travel by can be changed.

According to the invention, the at least one passenger vehicle is provided with a longitudinal drive fin, for engagement by the multiple booster drives mounted on the vehicle track, to displace the passenger vehicle along that vehicle track. The drive fin can be mounted in any position on the passenger vehicle, but is preferably mounted at the side of the passenger vehicle facing the vehicle track, normally the bottom of the passenger vehicle, and is preferably mounted in the center of the passenger vehicle, such that the drive fin is located in the middle of the track, for example is centered between load bearing rails of the vehicle track structure supporting the vehicle.

In an embodiment, the passenger vehicle comprises a passenger platform and an undercarriage. The passenger platform provides support, for example seats, for one or more passengers. The undercarriage forms the interface between the passenger platform and the track, and typically comprises a plurality of load bearing wheels and/or guide wheels. In an embodiment, the undercarriage comprises a frame with a set of wheels pivotably mounted at the front of the platform and a frame with a set of wheel pivotably mounted at the back of the passenger platform. The passenger vehicle can be configured such that it supports the passengers above the vehicle track structure or such that the passengers are supported below the vehicle track structure.

The longitudinal drive fin of the passenger vehicle provides a traction surface for engagement by the booster drive, more in particular for engagement by the booster wheels of the booster drives, mounted along the track. The drive fin is on opposite sides provided with traction surfaces, such that it can be pinched between two booster wheels. The drive fin can for example be a longitudinal plate or beam located at the side of the vehicle facing the track. To enable the booster drives to propel the passenger vehicle forward, a drive fin of considerable length and stiffness is needed. Typically, a drive fin has a length of at least 1,5 to 3 meters and extends in the longitudinal direction of the passenger vehicle.

To provide an optimal traction surface, the longitudinal drive fin preferably extends along the entire length of the passenger vehicle. Furthermore, to allow for optimal propulsion, the drive fin is preferably configured as a stiff body, for example a steel plate. Typically, a roller coaster comprises multiple combined passenger vehicles, which are linked together to form a train. In such an embodiment, the passenger vehicles are preferably each provided with a separate vehicle drive fin. For example, a train of nine linked passenger vehicles is provided with a series of nine discrete drive fins. In an embodiment, the separate drive fins are mounted such that they together form a substantially continuous drive fin extending along the length of the train.

Alternatively, two or more vehicles may share a single drive fin. In an embodiment, the passenger vehicles are linked to form a train. Each of the passenger vehicles comprises a passenger platform having one or more undercarriages and a drive fin extends between each two subsequent undercarriages. In such an embodiment, passenger vehicles may share a drive fin, which drive fin extends between an undercarriage of the first and an undercarriage of the second passenger vehicle.

According to the invention, the multiple booster drives mounted on the vehicle track comprise two booster wheels, at least one booster drive motor, a base, a frame, a mobile carrier and a biasing device.

The two booster wheels are configured for each engaging a side of the longitudinal drive fin mounted on a passenger vehicle, such that the fin is pinched between the booster wheels and the vehicle can be displaced along the vehicle track by driving one or both booster wheels. Thus, the two booster wheels form what is also known as a pinch wheel drive system for propelling the passenger vehicle along the track.

The at least one booster drive motor is configured to drive at least one of the two booster wheels. In an embodiment, the booster drive motor is configured to drive both booster wheels. In a further embodiment, the booster drive comprises two booster drive motors, each driving one of the two booster wheels.

According to the invention, the base of the booster drive is mounted to the vehicle track structure, while the frame supports the at least one booster drive motor. Both the base and the frame have a left side and a right side. The mobile carrier connects the frame to the base, and has at least one left carrier arm connecting the left side of the base to the left side of the frame and at least one right carrier arm connecting the right side of the base to the right side of the frame. According to the invention, the carrier arms of the mobile carrier are flexible arms and/or are pivotable connected to the base and/or the frame, such that in use they enable movement of the frame relative to the base in a direction substantially parallel to the support surface defined by the vehicle track while preventing substantial movement in a direction perpendicular to said support surface.

The carrier arms of the booster drive thus enable movement of the frame relative to the base, and thus enables movement of the at least one booster drive motor and the two booster wheels to the left and/or right and substantially parallel to the support surface defined by the vehicle track, i.e. in a lateral direction relative to the direction of travel of a passing vehicle. The biasing device resiliently forces the frame towards a predetermined position. This predetermined position, or neutral position, is the position the mobile carrier supports the frame when the booster drive is in rest, i.e. the booster wheels are not in contact with a drive fin.

The booster drive is mounted to the vehicle track such that the booster wheels of the booster drive, when the frame is located in its predetermined position, are positioned for pinching between them the longitudinal drive fin of an approaching passenger vehicle. According to the invention, the booster drive allows for lateral movement of the frame, and thus the booster wheels, i.e. movement to the left and/or right relative to the neutral positon. Thus, the booster drive is capable of coping with lateral movement of the longitudinal drive fin of a passing passenger vehicle while propelling that vehicle, i.e. while the longitudinal drive fin is pinched between the booster wheels.

Furthermore, by connecting the frame with the base via the at least one left carrier arm and the at least one right carrier arm according to the invention, the frame, when moved from left to right or vice versa, is kept substantially parallel to the base. The frame is thus moved substantially perpendicular to the direction of travel of a passenger vehicle passing the booster drive, which enables the booster drive to quickly and smoothly follow the drive fin when it moves relative to the center of the track while the passenger vehicle passes the booster drive.

Thus, according to the invention, the booster drives allow for lateral displacement of the longitudinal drive fin of the vehicle while propelling it along the track. Lateral movement of the drive fin relative to the track occurs when the passenger vehicle travels along a curved section of the track. Since the drive fin is a straight, stiff plate extending along the length of the vehicle, it will not follow the curvature of a curved track section exactly. Instead, relative to center of curvature of the track, the middle section of the drive fin will move inwards, i.e. towards the center of curvature of the track.

Since the biasing device of the booster drive resiliently forces the movable supported frame towards its predetermined position, the biasing device will return the at least one booster drive motor and the one or more booster wheels that have been moved in a lateral direction by the drive fin of a passing passenger vehicle back towards their initial, predetermined, position.

It is noted that prior art boosters are resiliently mounted to cope with some lateral displacement by the driving fin, for example to cope with misalignment of the drive fin due to wear of the vehicle, more in particular the wheels of the vehicle. This is typically achieved by mounting the booster drive on flexible rubber plates. However, this only provides a limited range of movement, i.e. only a 1-3 mm amplitude relative to the rest position, which does not allow for mounting the booster drives in substantially curved sections of the track. The configuration of the mobile carrier of a booster drive according to the invention allows for a range of movement of 4-8 mm amplitude or more relative to the rest position, for example for a working range of 10-15 mm. Thus, a booster drive according to the invention can also be mounted in substantially curved track sections. Furthermore, the mobile carrier provides for movement of the booster wheels in a direction substantially perpendicular to the direction of travel of the passenger vehicle, in combination with the use of arms for supporting the frame, this enables the booster wheels to more quickly and smoothly follow the driving fin compared to drive wheels that are mounted such that they would move along a curved trajectory when moved from left to right and vice versa.

Due to the flexible support of the booster drive motor and drive wheels, the booster drives can be mounted along straight sections of the track, and along curved sections of the track. Therefore, passenger vehicles can not only be propelled while traveling along the straight track sections but also while traveling along curved track sections, for example entering or exiting a curved section, such as a bend or even a loop or helical shaped track section. This allows for a better control of the speed with which the passenger vehicle travels along the track, and thus enhances the level of thrill that can be provided to the passengers of the vehicle.

Furthermore, by providing booster drives along curved sections of the track also, the lift hill at the beginning of the track can be reduced. This in turn allows for coasters with a smaller footprint. This is for example beneficial when designing an amusement ride that needs to fit between existing rides in an amusement park.

Also, by providing booster drives along curved track sections increased speeds can be achieved along the track, for example while entering or exiting a curve, which increase the thrill experienced by the passengers of the passenger vehicle.

It is noted that an amusement ride according to the invention, in addition to the booster drives according to the invention, may also comprise alternative propulsion devices, such as a lift hill, linear induction motors, traditional booster drives, etc.

The carrier arms preferably have a length in the range of 30 cm to 50 cm, more preferably in the range of 35 cm to 45 cm, for example have a length of 37 cm. In an embodiment, the carrier arms allow for movement of the frame in both the left and right direction over a distance in the range of 1 cm to 5 cm, more preferably in the range of 1 cm to 3 cm, for example over a distance of 2 cm to the left and 2 cm to the right.

In an embodiment the length of the carrier arms relates to the maximal distance over which the frame is moved in use with a factor of at least 10 preferably at least 15. For example, when the frame is configured to, during use, be moved from its initial position to the left or right over a distance of maximal 3 cm, the length of the carrier arms is at least 30 cm (10 times 3). Thus, the movement of the frame in a direction along the track, i.e. the direction of travel, caused by the curvature along which the frame is moved, is kept small which is beneficial for the interaction between the drive fin of the passing vehicle and the booster wheels.

In an embodiment, the at least one booster drive motor is provided at the side of the frame facing the base, and between the at least one left carrier arm and the at least one right carrier arm. In a further embodiment, two booster drive motors are provided at the side of the frame facing the base, and between the at least one left carrier arm and the at least one right carrier arm. Locating the at least one booster drive motor at the side of the frame facing the base and between the carrier arms allows for a highly compact booster drive in combination with long carrier arms. Furthermore, such a compact configuration of the booster drive allows for locating booster drives closely adjacent to each other along the track, as well as for placement of a booster drive between closely placed frame elements, such as cross beams, of the vehicle track.

In a further embodiment of an amusement ride according to the invention, the base, the frame and guide arms of the mobile carrier of the multiple booster drives are dimensioned such that they provide a box like configuration, the box having four walls, which walls are defined by the base, the frame and the mobile carrier, more in particular the arms of the mobile carrier. The box comprises the at least one booster drive motor to thus provide a compact booster drive. In an embodiment, the box like structure, when seen in top view, resembles a rectangle when the frame is its initial position, and resembles a parallelogram when the frame is moved in a lateral direction, i.e. to the left or right relative to the base.

It is observed that the compact configuration of the booster drives allows them to be mounted closely adjacent to each other, and thus in rows along the track, such that two or more booster drives engage a single longitudinal drive fin of a passenger vehicle.

In an embodiment of an amusement ride according to the invention, the booster drive comprises two drive motors, each driving a booster wheel mounted on the drive motor. In a further embodiment, the booster drive is provided with two booster wheels, each driven by its own booster drive motor. Preferably, the drive motors are adjustably attached to the frame, i.e. attached to frame such that their position can be adjusted relative to the frame in a direction substantially parallel to the support surface defined by the vehicle track and perpendicular to the direction of travel of a passenger vehicle passing the booster drive. By adjusting the position of the motor drives towards or away from each other, the booster wheels can be moved towards or away from each other. Thus, the nip for receiving the drive fin between the wheels can be adjusted, for example to compensate for wear of the wheels. For example, the motor drive can be mounted on the frame using bolts, which bolts are received in openings in the motor drive housing and in slots in the frame. Thus, when the bolts are loosened, the motor drive can be moved along the slots to adjust the position of the motor drive, and thus of the booster wheel supported by the motor drive. In another embodiment, the frame is not provided with slots but with multiple sets of openings for receiving the bolts, each sets of openings providing a different position of the motor drive on the frame.

In an embodiment of an amusement ride according to the invention, the at least one left carrier arm and the at least one right carrier arm of the multiple booster drives each are flexible arms, which flexible arms are with their ends fixed to the base and the frame, such that the displacement of the frame relative to the base is achieved by flexing of the arms. Thus, no hinges are needed. Providing flexible arms thus allows for a resilient, low friction and low maintenance flexible support of the frame.

In an embodiment, the resilient properties of the flexible arms contribute to the force that moves the movable supported frame towards a predetermined position. Thus, the flexible carrier arms may form part of the biasing device. In a further embodiment, the carrier arms are the biasing device, i.e. the resilient properties of the flexible arms are such that no separate device is required to force the frame, after it has been moved in a lateral direction, back towards its initial, predetermined, position. In yet a further embodiment, the resilient flexible arms are mounted such that they are biased when the frame is supported in its predetermined position.

In an embodiment of an amusement ride according to the invention, the at least one left carrier arm and the at least one right carrier arm of the booster drives comprise at least one spring blade, i.e. a sheet of spring steel, which spring blades are each with one end connected to the base and with an opposite end to the carrier, and which spring blades are substantially parallel to each other and substantially perpendicular to the support surface defined by the vehicle track. Furthermore, the blades are substantially parallel to the direction of travel of a passenger vehicle passing the booster drive. When the spring blade is mounted between base and frame such that it extends in a plane perpendicular to the support surface of the track, it can bend in a lateral direction, i.e. perpendicular to the direction of travel of a vehicle passing the booster drive, while providing a substantial stiff support in the vertical direction. Thus, spring blades allow for a simple, efficient mobile carrier which is low maintenance since there need to be no hinge-connections, i.e. pins revolving in bushings, and for a substantially compact booster drive. Furthermore, they have a low mass, and thus enable quick movement of the at least one booster drive motor in the lateral direction.

Furthermore, the resilient properties of the spring blades at least contribute to forcing the movable supported frame towards a predetermined position. Thus, no additional biasing device, or only a small additional biasing device is needed. In a preferred embodiment the spring blades are the biasing device, i.e. no additional biasing devices are provided to force the frame to its predetermined position.

In a further embodiment, the booster drive comprises carrier arms in the form of one or more spring blades, i.e. a sheet of spring steel, preferably forming a box type booster drive with the at least one booster drive motor located between the two carrier arms and between the base and frame. Thus, a low weight and compact booster drive can be provided. Especially the low weight is beneficial since it provides the booster drive with low inertia and thus enables the booster drive to be smoothly and quickly moved by the drive fin of a passing vehicle.

In a further embodiment according to the invention, the spring blades extend between the base and the frame, and are provided with a central reinforcement, for example in the form of a panel, for example a flexible rubber panel, a spring steel panel or a stiff metal panel, sandwiched with the spring blade between the opposite ends thereof. Thus, the spring blades are provided with a stiffer central section and flexible end sections. Thus, when the frame is moved out of its predetermined position, the bending of the arms is localized in the end sections of the arms, i.e. in the sections of the arm localized between the stiffened midsection and the parts of the arm mounted to the base or frame. Flexing only parts of the arms instead utilizing fully flexible arms reduces the chances of buckling of the arms when the arms are loaded under pressure. Such a configuration is therefore especially beneficial when the booster drives are to propel passing vehicles in both directions along the track, and the carrier arms are loaded under tension (when propelling a vehicle in a first direction) as well as under pressure (when propelling a vehicle in the opposite direction).

Advantageously, a central reinforcement in the form of a flexible element, such as a rubber panel or spring steel panel, also functions as a dampening element that dampens residual movement of the frame after a vehicle has passed the booster drive. Thus, the frame of the booster settles more quickly in its predetermined position.

In an advantageous embodiment, the carrier arms comprise one or more spring blades, i.e. sheet of spring steel. In a further embodiment, each carrier arm comprises a main spring blade with one or more spring blades mounted on the central part thereof as central reinforcement.

In an alternative embodiment, the carrier arms are composed of different materials, and for example comprise a stiff midsection in the form of a steel plate, and flexible outer sections in the form of spring blades provided at the opposite ends of the central section, connecting the steel plate with the base and frame respectively. Thus, a carrier arm can be provided with a stiff non flexible midsection and flexible connections, instead of hinge connections, between the midsection and the base and between the midsection and the frame.

In a further embodiment, the stiffer midsection of the carrier arms is provided with apertures to reduce the weight of the carrier arms. It is noted that also a carrier arm provided in the form of a single blade of spring metal can be provided with such openings.

In an alternative embodiment according to the invention the at least one left carrier arm and the at least one right carrier arm of the booster drives are each non-flexible arms, which non-flexible arms are with their ends pivotably connected to the base and the frame, i.e. are provided with hinge connections, such that the displacement of the frame relative to the base is achieved by pivoting of the arms relative to the base and the frame instead of flexible deformation of the arms or part of the arms.

It is observed that non-flexible in this document means that the element is configured to not, or not significantly, bend during use, while flexible indicates that the element is configured to bend during use, more in particular that the bending is part of its functional requirement, i.e. enables the booster drive to function during use.

In a further embodiment, the at least one left carrier arm and the at least one right carrier arm each comprise a non-flexible plate, for example a steel plate, which non-flexible plates are each with one end pivotable connected, for example are clamped in a rubber mounting, to the base and with an opposite end are pivotably connected, for example via a hinge connection, to the frame.

In an embodiment, the booster drive is mounted in the track such that the carrier arms of the mobile carrier extend in the direction of travel and the frame is located upstream and the base is located downstream with respect to the direction of travel, such that the carrier arms of the mobile carriers are loaded under tension when the booster drive propels a passing passenger vehicle.

In an embodiment of an amusement ride according to the invention, the biasing device comprises at least one of the carrier arms, which carrier arm is provided in the form of a resilient carrier arm, for example a carrier arm comprising a spring blade, such that the carrier arm, and thus the frame supporting the booster wheels, is resiliently forced towards a predetermined position.

In an embodiment of an amusement ride according to the invention, the biasing device comprises resilient elements coupled with the at least one left carrier arm and/or the at least one right carrier arm, such as a spring elements between the arm and the base or rubber mountings connecting the arms with the base and/or frame, to force the carrier arms, and thus the frame supporting the booster wheels, towards a predetermined position.

In an embodiment of an amusement ride according to the invention, the biasing device comprises at least one alignment arm, the alignment arm being a stiff arm that extends between the base and the frame. The alignment arm is at a first end fixed to the base, while its opposite end is connected to frame via damping elements, for example a hydraulic cylinder or spring, which resilient elements force the frame towards a predetermined position.

In an alternative embodiment the alignment arm is at a first end fixed to the frame, while its opposite second end engages damping elements mounted on the base, for example a hydraulic cylinder or spring, which resilient elements force the at least one alignment arm, and thus the frame, towards a predetermined position.

Preferably, the damping elements are configured such that they exert their main damping force in the lateral direction. For example the alignment arm is fixed to the base, and has a length such that its second end is located adjacent the frame. On opposite sides of the second end, a hydraulic cylinder is provided, extending in the lateral direction and mounted with one end to the frame, or to a mount provided on the frame, and with an opposite end to the alignment arm. Thus, when the frame is moved in the lateral direction by the drive fin of a passing passenger vehicle, the resilient elements are compressed and extended respectively, depending on their positioned relative to the end of the alignment arm, thus forcing the frame towards its initial, i.e. the predetermined or neutral, position.

In a further embodiment according to the invention, the first end of the alignment arm is fixed to either the frame or the base and respectively the base or frame is provided with a bracket that passes through an opening provided in the second end of the alignment arm, such that the alignment arm will rest on the bracket, or the bracket on the alignment arm, when one or more of the carrier arms are removed. Thus, when the carrier arms are removed the frame is supported by the alignment arm. This facilitates replacing the carrier arms, for example during maintenance, since the frame is substantially kept in position by the alignment arm when a carrier arm is removed.

In an embodiment of an amusement ride according to the invention, the multiple booster drives comprises two booster drive motors, each configured to drive one of the booster wheels.

In a further embodiment, the booster wheels are each provided directly on a drive shaft of the respective drive motors, which drive motors are mounted adjacent to each other on the frame.

In a further embodiment according to the invention the frame of the multiple booster drives comprises a left support part, having a left side and a right side, which left support part supports one of the two drive motors, and a right support part, having a left side and a right side, which right support part supports the other of the two drive motors.

The separate left and right support part of the frame are adjustable connected, such that the right side of the left support part faces the left side of the right support part, and such that the distance between the left support part and the right support part, and thus the distance between the booster wheels, can be adjusted. Thus, not the position at which the motors are mounted on the frame needs to be adjusted, but the frame parts supporting the respective motor drives can be adjusted relative to each other to adjust the nip between the booster wheels.

In a further embodiment according to the invention the left support part and the right support part of the frame are each provided with a left carrier arm and a right carrier arm. Thus, in addition to the at least one left carrier arm and the at least one right carrier arm, which respectively connect the left side of the left frame part and the right side of the right frame part to the base, in this embodiment the mobile carrier comprises at least one left centre carrier arm and at least on right centre carrier arm. The at least one left centre carrier arm connects the right side of the left support part with a centre area of the base and the at least one right centre carrier arm connects the left side of the right support part with the centre area of the base. The at least one left centre carrier arm and the at least one right centre carrier arm are flexible and/or are pivotable connected to the base and/or the left support part and the right support part respectively, such that they enable movement of the left frame part and the right frame part relative to the base in a direction substantially parallel to the support surface defined by the vehicle track while preventing substantial movement in a direction perpendicular to said support surface.

In an embodiment, each booster drive comprises two booster drive motors, each driving a booster wheel, and an actuator system that allows for moving the two booster drives between an active position in which the booster wheels can pinch a drive fin between them, and a passive position, in which the booster drives are moved away from each other such that the drive fin of a passenger vehicle can pass between the booster wheels of the booster drive without the drive fin contacting the booster wheels. In an embodiment, the booster drive comprises a frame with two frame parts, each supporting a booster drive motor, and the actuator system is configured for moving the frame parts towards and away from each other. In an alternative embodiment, the two drive motors are each movably mounted on the single frame, and the actuator system is configured to move them relative to the frame part towards each other and away from each other.

In an embodiment of an amusement ride according to the invention, the booster drive motors are high performance electric motors, for example high performance DC motors or AC motors.

A further embodiment of an amusement ride according to the invention further comprises a vehicle control system for interfacing with motor controllers of the booster drives provided along the vehicle track, and to thus control the drive speed of the booster drives, more in particular the rotational speed of the booster wheels, and thus the speed of the at least one passenger vehicle while moving along the track. In a further embodiment, the vehicle control system is also configured to control the direction of rotation of the booster wheels, such that the booster drives can be used in for propelling a vehicle in two, opposed, directions along the track. In a further embodiment, the vehicle control system is configured to control the mutual position of the booster wheels, and is configured to move the booster wheels apart to thus allow a drive fin of a passing vehicle to pass between the booster wheels without contacting the booster wheels. The invention furthermore provides a booster drive adapted to be mounted on a vehicle track for providing an amusement ride according to the invention.

The invention furthermore provides a booster drive mounting assembly, comprising a base, a frame, a mobile carrier and a biasing device, which mounting assembly is configured for mounting two booster drives on a vehicle track for providing an amusement ride according to the invention.

The invention furthermore provides a method for mounting a booster drive to a vehicle track for providing an amusement ride according to the invention, and a method for replacing a booster drive of an amusement ride according to the invention.

It is observed that a booster drive according to the invention comprising can also be used for slowing down a passing passenger vehicle instead of driving it. When the booster drive motors are electrically driven motors, the booster drive can also be used for generating energy when slowing down a passing vehicle.

Advantageous embodiments of the amusement ride, of a booster drive according to the invention, and the method according to the invention are disclosed in the sub claims and in the description, in which the invention is further illustrated and elucidated on the basis of a number of exemplary embodiments, of which some are shown in the schematic drawing.

BRIEF DESCRIPTION OF THE DRAWINGS

In the Drawings

FIG. 6A shows a top view of a third embodiment of a booster drive according to the invention with part of the booster drive pictured in partial see through;

FIG. 7 shows a rear view of the booster drive of FIG. 6 with part of the booster drive pictured in partial see through;

FIG. 10A shows a side view of the booster drive of FIG. 6 with part of the booster drive pictured in partial see through; and FIG. 10B shows a side view in cross section of the booster drive of FIG. 6 with part of the booster drive pictured in partial see through.

DETAILED DESCRIPTION

Figure 1A:
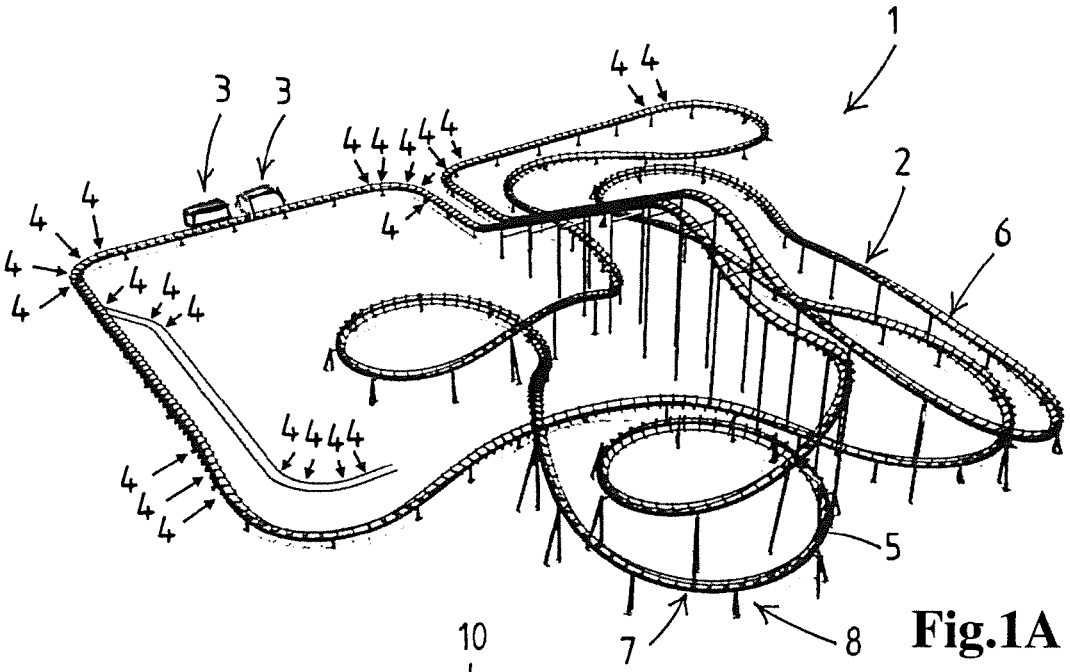
FIG. 1A shows a perspective view of a schematic lay out of an amusement ride according to the invention.
Figure 1B:
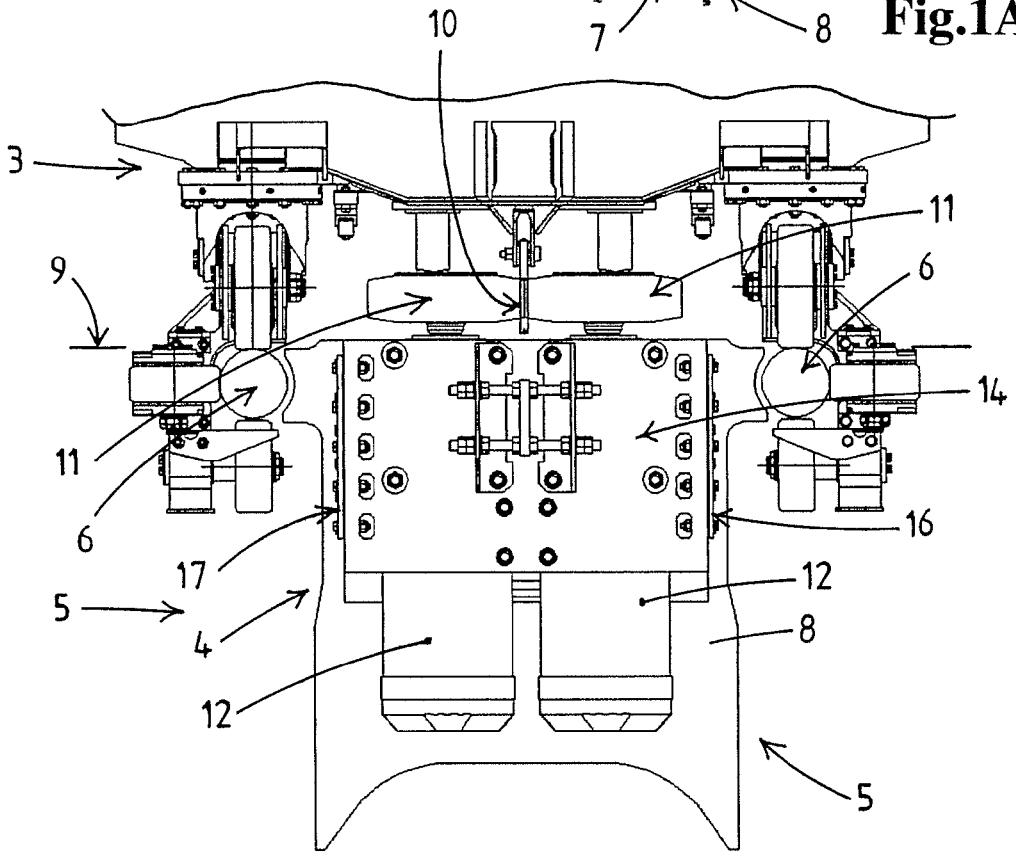
FIG. 1B shows a track of the amusement ride of FIG. 1 in cross section.

FIG. 1A shows a perspective view of a schematic lay out of an amusement ride 1 according to the invention. The amusement ride comprises a vehicle track 2, multiple passenger vehicles 3, and multiple booster drives 4 mounted along the vehicle track to displace the passenger vehicles along that vehicle track. FIG. 1B shows the track 2 of the amusement ride 1 of FIG. 1 in cross section, with part of a passenger vehicle 3 and a booster drive 4 mounted to the vehicle track 2.

Figure 2:
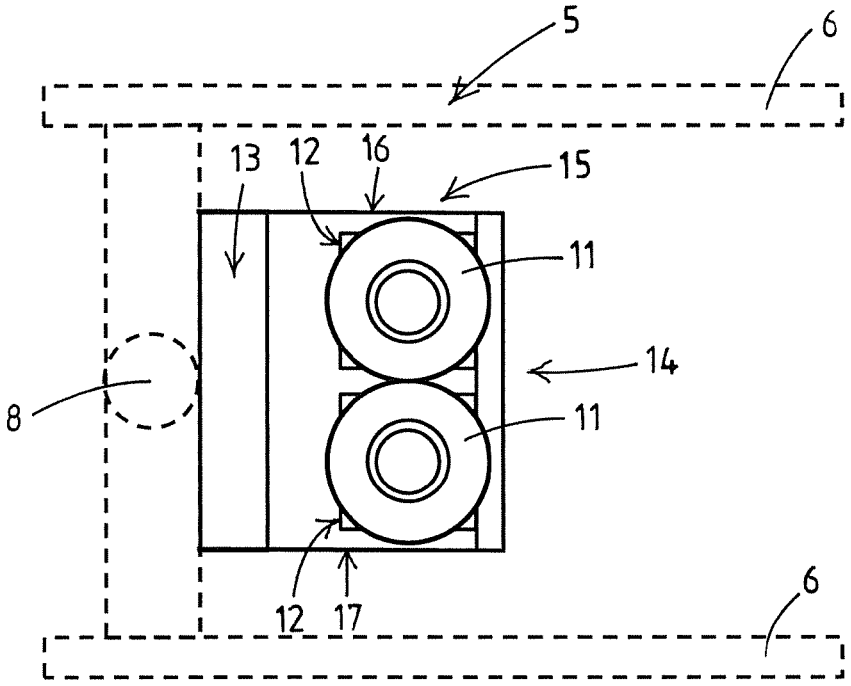
FIG. 2 shows a top view of a first embodiment of a booster drive according to the invention.
Figure 3:
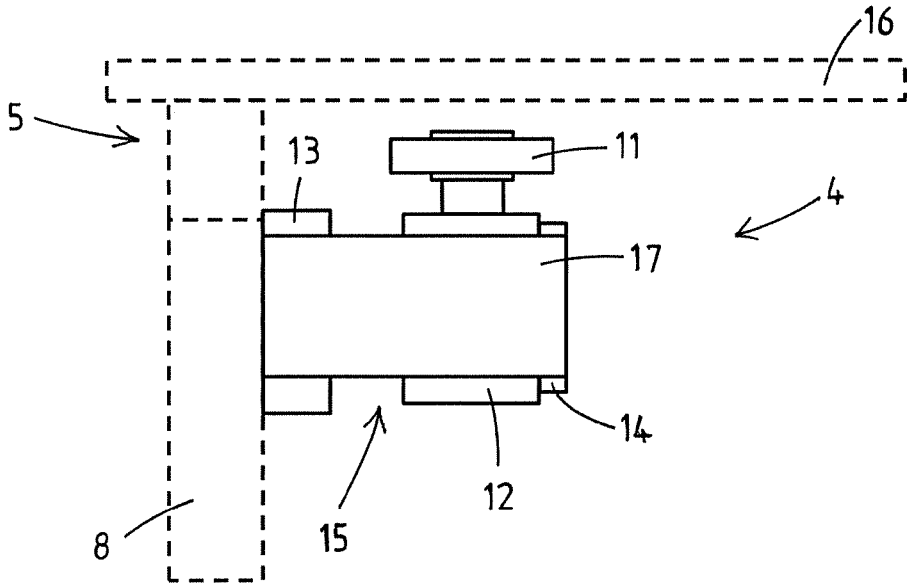
FIG. 3 shows a side view of the booster drive of FIG. 2.

FIG. 2 shows a top view of a first embodiment of a booster drive 4 mounted along the vehicle track 2 of FIG. 1A. In the embodiment shown, the vehicle track 2 comprises a vehicle track structure 5 in the form of a rail track, which rail track comprises parallel, spaced apart load bearing rails 6 positioned above a base or backbone 7 by a plurality of spaced apart rail supports, and which rail track is supported on pillars 8. The vehicle track 2 defines a support surface 9 for supporting a passenger vehicle and is configured for guiding the passenger vehicle along the vehicle track. FIG. 3 shows a side view of the booster drive 4 and the vehicle track 2.

It is noted that in FIGS. 1B and 2 only a section of the vehicle track is shown, which, for explanatory reasons, has been depicted in dotted lines. Furthermore, in the embodiment shown, the booster drive 6 is mounted on a pillar 8 that is part of the track structure 5. The booster drive can be mounted to the track structure in alternative ways, for example can be mounted on a plate or cross beam that in turn is fixed to the load bearing rails 6 and or back bone 7.

The booster drive 4 comprises two booster wheels 11, which in the embodiment shown are each driven by a booster drive motor 12.

The two booster wheels 11 are configured for each engaging a side of a longitudinal drive fin 10, shown in FIG. 1*b*, mounted on the amusement vehicle 3 traveling along the vehicle track 2, such that the fin 10 is pinched between the booster wheels 11 and the vehicle can be displaced along the vehicle track 2 by driving the booster wheels using the respective drive motors 12.

In alternative embodiment, one booster drive motor is provided, which one booster drive motor is configured to drive the two booster wheels.

The booster drive 4 further comprises a frame 14, a mobile carrier 15, and a base 13.

The frame 14 supports the booster drive motors 12, and thus the two booster wheels 11 mounted on the respective drive motors. It is noted that with booster drives, typically the booster drive wheels are mounted directly onto the drive axis of the booster drive motor. However, alternative designs can also be used.

The mobile carrier 15, comprising a left carrier arm 16 and a right carrier arm 17, connects the frame 14 to the base 13. The base 13 and the frame 14 each have a left side and a right side. The left carrier arm 16 of the mobile carrier 15 connects the left side of the base 13 to the left side of the frame 14. The right carrier arm 17 of the mobile carrier 15 connects the right side of the base 13 to the right side of the frame 14.

Herein, the left carrier arm is considered to be the carrier arm that is at your left when you would be facing the frame with your back towards the base.

As was already mentioned, the base 13 of the booster drive is mounted to the vehicle track structure 15, in the particular embodiment shown against the pillar 8 supporting the rail track. The base 13 of the booster drive 4 is mounted to the vehicle track structure such that the booster wheels 11 are positioned relative to the track for receiving between them the longitudinal drive fin 10 of an approaching passenger vehicle, pinch that drive fin between them, and propel the passenger vehicle along the track while it passes the booster drive.

In the embodiment shown, the carrier arms 16,17 are flexible arms that enable movement of the frame 14 relative to the base 13 in a direction substantially parallel to the support surface defined by the vehicle track, while preventing substantial movement in a direction perpendicular to said support surface. According to the invention, the flexible arms thus enable lateral movement, i.e. movement to the left and/or right, of the booster wheels and therefore allow for lateral movement of the longitudinal drive fin of a passing passenger vehicle, while the longitudinal drive fin is pinched between the booster wheels.

Lateral movement of the drive fin relative to the track, and thus relative to the base of the booster drive, occurs for example when the passenger vehicle travels along a curved section of the track. Since the drive fin is a straight, stiff plate or similar element that extends along the length of the vehicle, it will not follow the curvature of a curved track section exactly. Instead, considered from a fixed point at the center of a section of the track, which section of the track is curved about a centre of curvature, the drive fin of a passing passenger vehicle will move towards the center of curvature of that track section, i.e. the drive fin will move inwards, and back outwards again, while the passenger vehicle passes the fixed point.

In the embodiment shown, the left and right carrier arm 16,17 each are spring blades. The spring blades are each with one end connected to the base 13 and with an opposite end to the carrier 14. The spring blades are substantially parallel to each other and to the direction of travel of a passenger vehicle passing the booster drive, and substantially perpendicular to the support surface defined by the vehicle track. In the embodiment shown, the spring blades are with their ends fixed to the base and to the frame, such that the displacement of the frame relative to the base is achieved by flexing of the arms, more in particular by flexing of the spring blades.

According to the invention, the booster drive further comprises a biasing device, which in the shown embodiment is integrated in the carrier arms of the mobile carrier. The biasing device resiliently forces the frame towards a predetermined position, being the position in which the booster wheels can engage the drive fin of an approaching passenger vehicle. The biasing device will return the at least one booster drive motor and the one or more booster wheels that have been moved in a lateral direction by the drive fin of a passing passenger vehicle back towards their initial, predetermined, position. Thus, the booster wheels are correctly positioned for engaging the drive fin of the next passenger vehicle.

It is submitted that the biasing device of a booster drive according to the invention is configured for quickly returning the frame towards its predetermined position. It is however noted that the drive fin often is mounted to the passenger vehicle such that its front end rear end are located near the center of the track when the passenger vehicle negotiates a curved section of the track, and that it is the midsection of the drive fin that is located at a distance of the center of the track in the curved track sections. Thus, the maximal displacement of the frame will occur when the drive fin is halfway through the booster drive, and the frame will again be positioned near its neutral position when the drive fin exits the nip between the booster wheels. Thus, the biasing device will only have to move the frame over a little distance to bring it back into its neutral position after the passenger vehicle has passed the booster drive.

In the embodiment shown in FIGS. 2 and 3, the biasing device comprises the carrier arms, which carrier arms are both provided in the form of a resilient carrier arm, in particular in the form of a carrier arm comprising a spring blade. Thus, the biasing device is integrated in the spring blades that form the carrier arms 16, 17. Due to their resilient properties, the spring blades resiliently force the frame, and thus the booster wheels supported by that frame, towards the predetermined position.

In an alternative embodiment, for example in an embodiment in which the carrier arms are non-resilient arms which are pivotably mounted to the base and to the frame, the biasing device is for example provided in the form of separate resilient bodies, or in the form of a hydraulic cylinder, which are provided between the base and the frame, or between the frame or base on one end and a carrier arm on the other end, to resiliently force the frame towards its predetermined position relative to the base, in which predetermined position the booster wheels can engage the drive fin of a passing passenger vehicle.

In the booster drive 4 shown in FIGS. 2 and 3, the two booster drive motors 12, are provided at the side of the frame 14 facing the base 13, and between the left carrier arm 16 and the right carrier arm 17. Furthermore, the base 13, the frame 14 and the carrier arms 16,17 of the mobile carrier 15 are dimensioned such that they provide a box like configuration. The box has four walls defined by the base 13, the frame 14 and the carrier arms of the mobile carrier 15, and envelops the booster drive motors. This configuration of the booster drive thus provides a compact booster drive.

Figure 4:
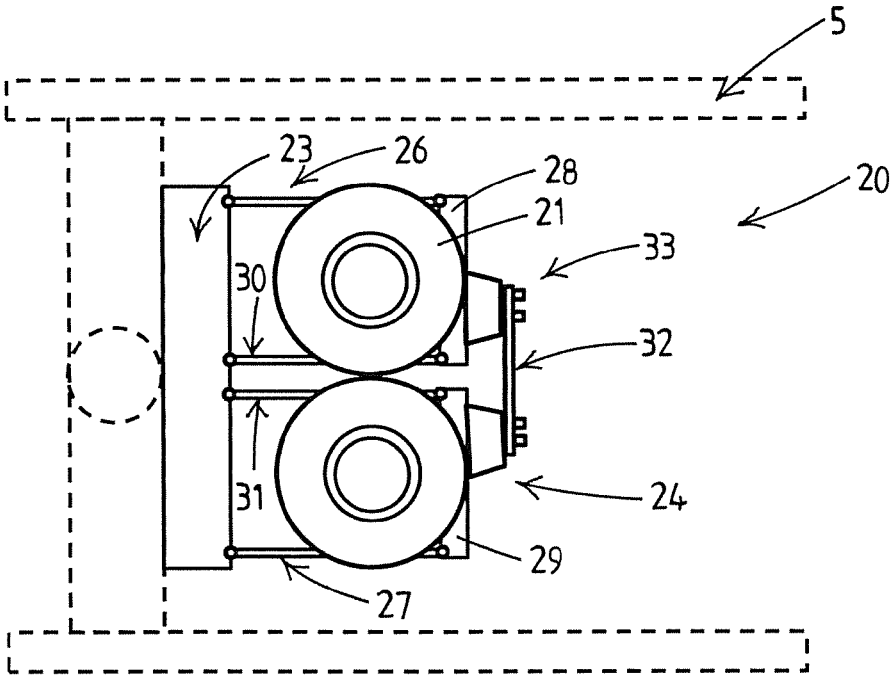
FIG. 4 shows a top view of a second embodiment of a booster drive according to the invention.
Figure 5:
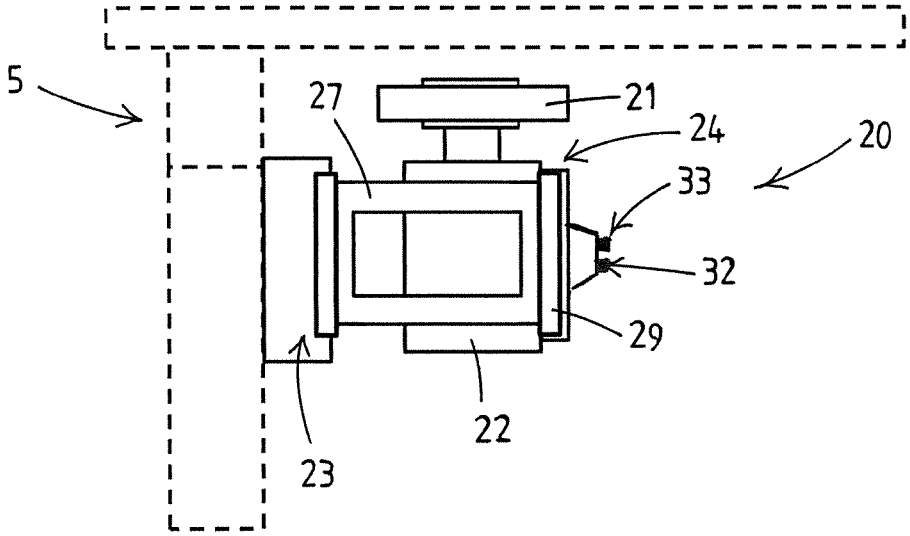
FIG. 5 shows a side view of the booster drive of FIG. 4.
Figure 6A:
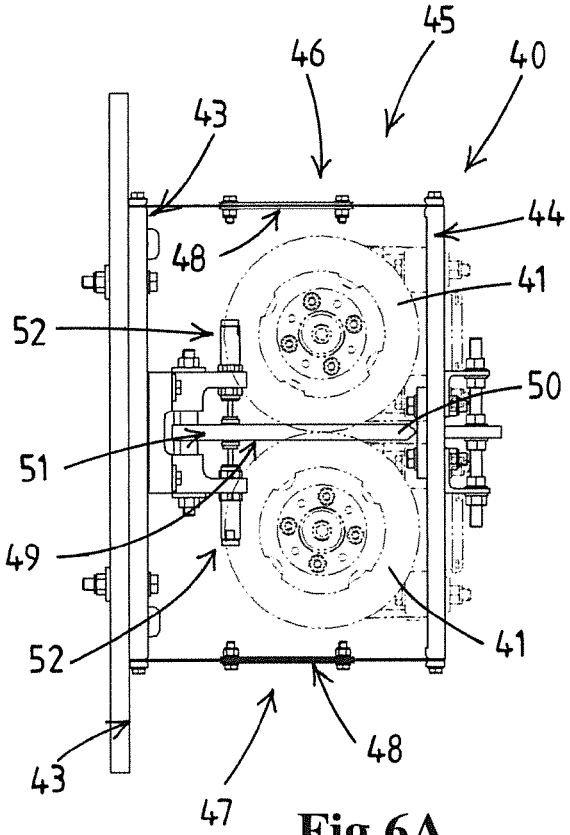
Figure 6B:
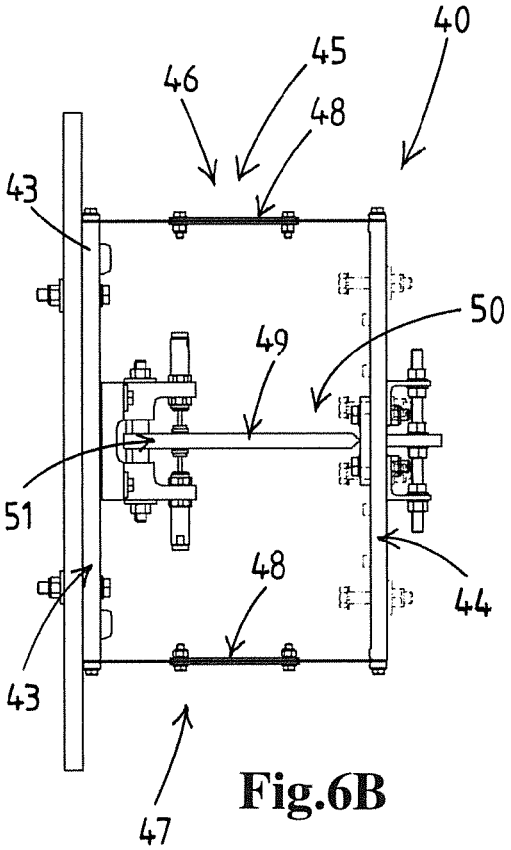
FIG. 6B shows a top view of part of the booster drive of FIG. 6.
Figure 7:
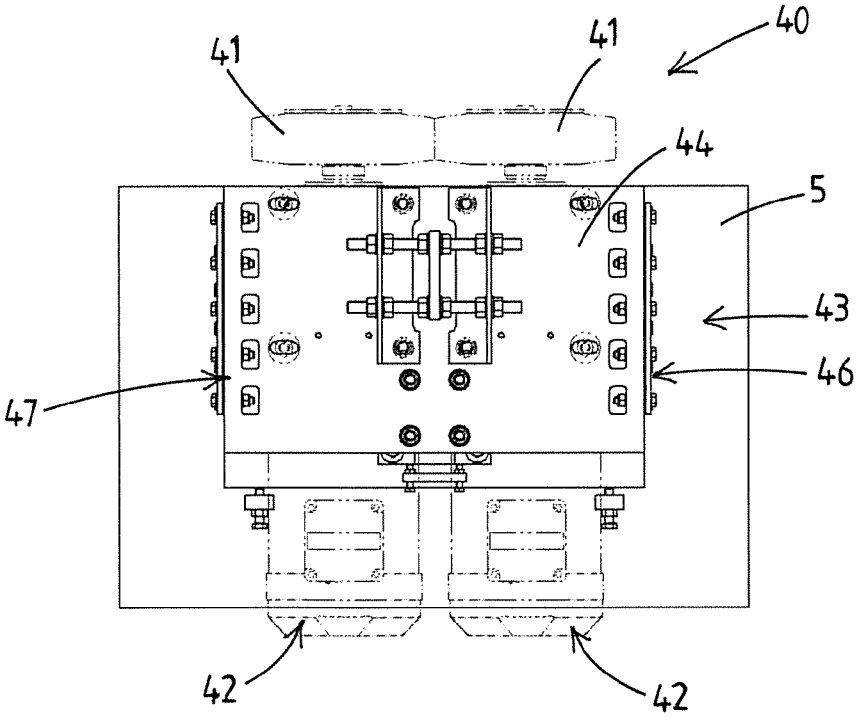
Figure 8:
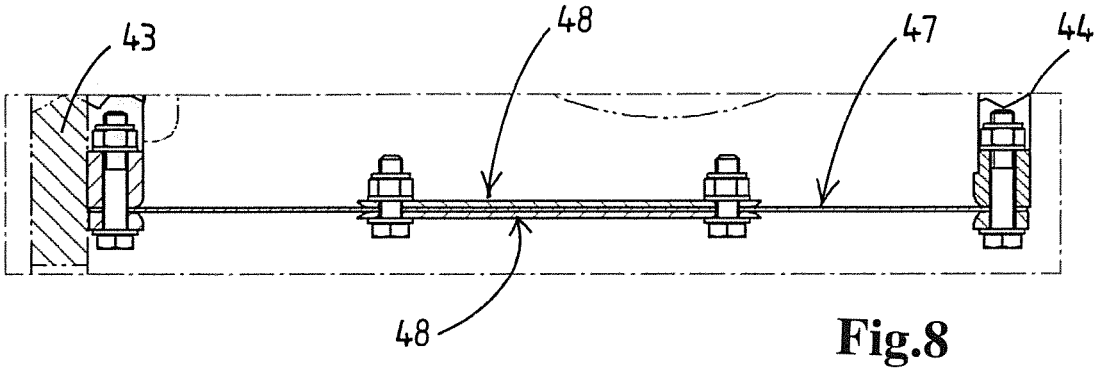
FIG. 8 shows in close up a top view of a carrier arm of the booster drive of FIG. 6.
Figure 9:
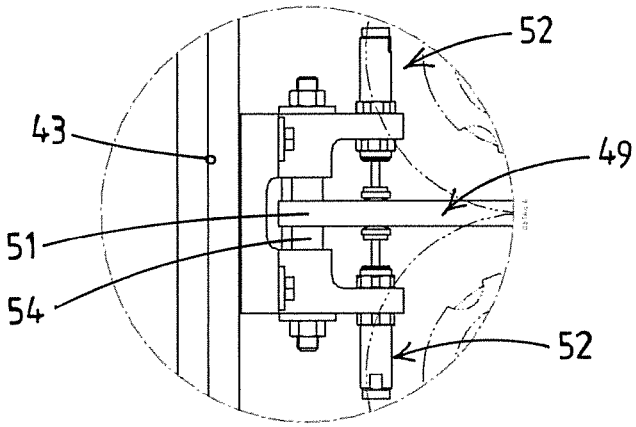
FIG. 9 shows in close up a top view of an end of an alignment arm of the booster drive of FIG. 6.

FIGS. 4 and 5 respectively shows a top view and a side view of an alternative embodiment of a booster drive 20 according to the invention, which is mounted with its base 23 to the vehicle track 2 of the amusement drive 1. Similar to the booster drive 4 shown in FIGS. 2 and 3, the booster drive 20 shown in FIGS. 4 and 5 comprises two booster drive motors 22, each driving a booster wheel 21.

In contrast with the first embodiment shown in FIGS. 2 and 3, the booster drive 20 shown in FIGS. 4 and 5 has a frame 24 supporting the booster drive motors 22 that comprises a left support part 28, having a left side and a right side, and a right support part 29, having a left side and a right side. The left support part 28 and the right support part 29 each support one of the two drive motors. It is noted that the right side of the left support part 28 faces the left side of the right support part 29.

In the preferred embodiment shown, the mobile carrier 25, in addition to a left carrier arm 26 and a right carrier arm 27, comprises a left centre carrier arm 30, connecting the right side of the left support part 28 with a centre area of the base 23, and a right centre carrier arm 31, connecting the left side of the right support part 29 with the centre area of the base 23.

In the embodiment shown, the left carrier arm 26, the left centre carrier arm 30, the right centre carrier arm 31, and the right carrier arm 27, are all non-flexible arms which are pivotably connected to the base 23 and the left support part 28 and the right support part 29 respectively. The carrier arms thus enable movement of the left frame part and the right frame part relative to the base in a direction substantially parallel to the support surface defined by the vehicle track while preventing substantial movement in a direction perpendicular to said support surface.

The left support part 28 and the right support part 29 are adjustable connected such that the distance between the left support part and the right support part, and thus the distance between the booster drive wheels 21, can be adjusted. In the embodiment shown the left and right support part 28,29 are connected via a rod 32. This connecting rod 32 is provided with slots, in which bolts 33 are mounted that clamp the rod against the support parts.

To adjust the distance between the two drive wheels 21, the bolts 33 are released such that they no longer clamp the connecting rod 32 against the left support part 28 and/or right support part 29. Thus, the connecting rod no longer positions the left support part relative to the right support part, and their relative position, and thus the position of the drive wheels 21 relative to each other, can be adjusted. When the new relative position of the support parts has been established, the bolts are fastened, and the position of the support parts relative to each other is again secured.

It is noted that instead of a rod, a resilient element can be used to connect the left support part and the right support part, which resilient element can be used to bias the left support part and the right support part towards each other, and thus clamp the booster wheels against each other.

In a further embodiment, the left support part and the right support part are connected by an controlled actuator part which in an active position keeps the left support part and the right support part at a predetermined mutual distance such that the booster wheels are clamped onto each other, and in an inactive position keeps the left support part and the right support part at a mutual distance such that the booster wheels do not contact each other, and the drive fin of a passing passenger vehicle can pass between the booster wheels without touching them. Thus, the booster drive can be switched between an active position for propelling a passenger vehicle along the track and an inactive position in which it does not interfere with passing passenger vehicles.

Similar to the embodiment shown in FIGS. 2 and 3, the booster drive motors 22 are both provided at the side of the frame 24 facing the base 23 and between the left carrier arm 26 and the right carrier arm 27. The base 23, the frame 24 and the carrier arms 26,27 of the mobile carrier 25 are dimensioned such that they provide a box like configuration. The box has four walls defined by the base 23, the frame 24 and the mobile carrier 25, and comprises the booster drive motors. This configuration of the booster drive thus provides a compact booster drive.

In addition, the drive motors 22 are each provided between a carrier arm and a centre carrier arm, such that they are each provided in a sub box also. In a further embodiment of a booster drive according to the invention, the base comprises a left part, which is part of the box housing the left booster drive, and a right part, which is part of the box housing the right booster drive, such that the booster drive comprises two sub units, each sub unit comprising a base part, a carrier arm, a centre carrier arm, a support part and booster drive supporting a booster drive wheel. This allows for replacing one of the sub units, for example for replacing a booster drive to enable maintenance, without the need of removing both at the same time.

The embodiment shown in FIGS. 4 and 5 further differs from the embodiment shown in FIGS. 2 and 3 in that the carrier arms each are non-flexible arms, which non-flexible arms are with their ends pivotably connected to the base and the frame, such that the displacement of the frame relative to the base is achieved by pivoting of the arms relative to the base and the frame.

In the embodiment shown, the carrier arms each comprise a non flexile plate, in the embodiment shown a steel plate, which non-flexible plates are each with both ends pivotable connected, in the embodiment shown are clamped in a rubber mounting, to the base and the support parts of the frame.

In the embodiment shown, biasing device is integrated in the flexible mountings. The resilient properties of the rubber mountings also provide the force that resiliently forces the frame towards a predetermined position.

In an alternative embodiment, the biasing device is provided in the form separate resilient elements, for example springs, which are coupled with the base at one end and with a carrier arm and/or with the frame at an opposite end, such that they force the carrier arms, and thus the frame supporting the booster wheels, towards a predetermined position.

In another alternative embodiment, one or more of the carrier arms can be configured as flexible, preferably flexible and resilient carrier arms, for example similar to the carrier arms shown in the embodiment of FIGS. 2 and 3.

FIGS. 6A, 6B and 7 and 10A, 10B respectively show a top view, a rear view and a side view of a second alternative embodiment of a booster drive 40 according to the invention. The booster drive shown in these Figs. is similar to the booster drive 4 shown in FIGS. 2 and 3.

The booster drive 40 comprises two booster wheels 41, which are each driven by their own booster drive motor 42. The booster drive 40 further comprises a base 43, a frame 44, and a mobile carrier 45 having a left carrier arm 46, which connects the left side of the base 43 to the left side of the frame 44, and right carrier arm 47, which connects the right side of the base 43 to the right side of the frame 44.

Also similar to the embodiment shown in FIGS. 2 and 3, the carrier arms 46,47, which in use enable movement of the frame 44 relative to the base 43 in a lateral direction to compensate for lateral movement of the drive fin of a passing passenger vehicle, are flexible arms.

Furthermore, in the embodiment shown in FIGS. 6-10, the left and right carrier arm 46,47 are also each provided in the form of spring blades, which are each with one end connected to the base 43 and with an opposite end to the carrier 44. The spring blades are substantially parallel to each other, and thus allow for movement of the frame relative to the base in a direction substantially perpendicular to a plane defined by each spring blade. Furthermore, they keep the frame substantially parallel to the base while moving it.

The embodiment shown in FIGS. 6-10 differs from the one shown in FIGS. 2 and 3 in that the spring blades are provided with a central reinforcement. In the embodiment shown, the reinforcement is provided in the form of additional panels 48 of a, compared to the blade springs non-flexible material, on opposite sides of the spring blade. Thus, the middle section of the spring blades is sandwiched between the stiff support plates 48, which are bolted onto the spring blades, which is shown in more detail in the top view in FIG. 8.

The support plates 48 provide the spring blades with a stiff central section and flexible sections at the ends, i.e. the sections of the spring blades that extend between the support plates and the frame and between the support plates and the base respectively. The bending of the arms is thus limited to these end sections, which reduces the chance of buckling of the spring blades when the arms are loaded under pressure. This is advantageous when the booster drive should be able to drive a passenger vehicle in opposite directions along the track.

Figure 10A:
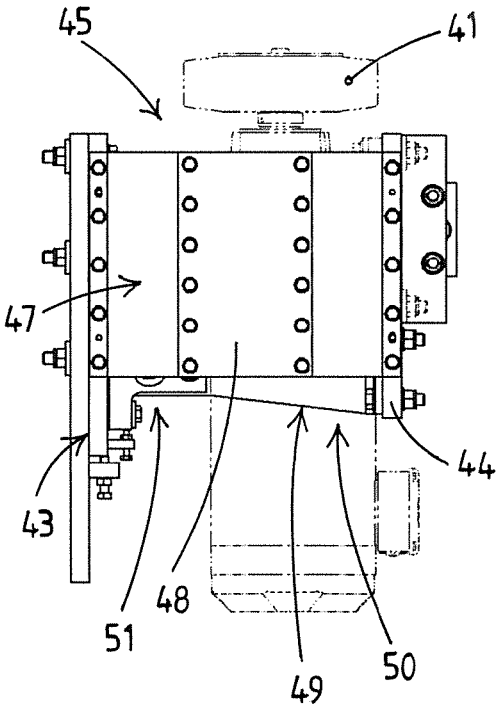
Figure 10B:
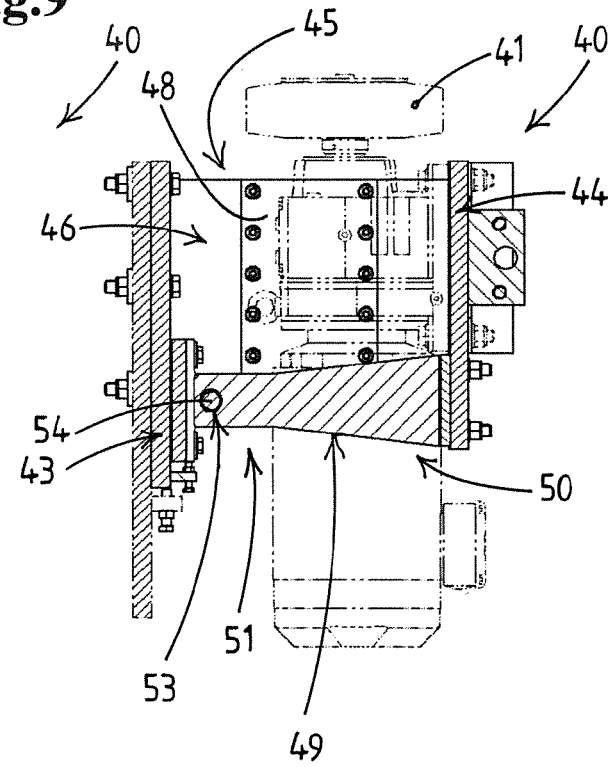

The booster drive shown comprises an alignment arm 49, which alignment arm is a stiff arm that extends between the base 43 and the frame 44. The alignment arm 49 is at a first end 50 fixed to the frame 44. The opposite, second end 51 of the alignment arm 49 is located adjacent the base 43. FIG. 10B shows a side view of the booster drive of FIG. 6A in cross section, with a carrier arm and booster drive removed, to show the alignment arm 49.

It is observed that by providing the booster drive with two or more parallel carrier arms, the frame, when moved relative to the base, moves substantially parallel to the base. Thus, when the frame is moved relative to the base, for example due to the drive fin of a passing vehicle moving in a lateral direction relative to the track, the second end of the alignment arm 49 moves substantially along the base. In the embodiment shown, the booster drive 40 is provided with damping elements in the form of cylinders 52 which are mounted on the base 43 and engage the second end 51 of the alignment arm. In the preferred embodiment shown, damping elements are provided on the left side and the right side of the second end of the alignment arm, which is shown in close up in a top view of in FIG. 9. The damping elements force the at least one alignment arm 49, and thus the frame 44 towards the predetermined position. In particular when the alignment arm is combined with damping elements such as cylinders, its main purpose is to dampen any residual lateral movement, caused by the displacement of the frame by the drive fine, after the passenger vehicle has passed the booster drive. Thus, the frame is more quickly located in its predetermined position.

In an alternative embedment, the alignment arm is mounted on the base with its free end located adjacent the frame, and are the damping elements provided between the free end and the frame.

In an embodiment according to the invention, the booster drive is provided with an alignment arm of which the first end is fixed to either the frame or the base and respectively the base or frame is provided with a bracket that passes through an opening provided in the second end of the alignment arm, such that the alignment arm will rest on the bracket when one or more of the carrier arms are removed. It is noted that alternative configurations, for example an opening in the base or frame that receives the free end of the alignment arm or a pin in bus connection can also be used.

In the embodiment shown in FIGS. 6-10, the first end 50 of the alignment arm 49 is fixed to the frame and the second end 51 of the alignment arm 49 is provided with an opening 53. The base is provided with a bracket 54 that passes through the opening 53. During normal use there is no or just little interaction between the support bracket and the alignment arm, however, when one of the carrier arms is disengaged from the base and/or the frame, the alignment arm will rest on the bracket thus providing additional support of the frame in this situation. This is for example beneficial when replacing a carrier arm or when removing a carrier arm to provided access to the booster drive, for example to allow for maintenance without the need of removing the booster drive from the track.

According to the invention, the booster drive shown in FIGS. 6-10, comprises a biasing device 48, which biasing device resiliently forces the frame towards a predetermined position, being the position in which the booster wheels can engage the drive fin of an approaching passenger vehicle. The biasing device will return the booster drive wheels, when they have been moved in a lateral direction by the drive fin of a passing passenger vehicle, back towards their initial, predetermined, position for receiving a drive fin of a next passenger vehicle.

As was the case with the embodiment shown in FIGS. 2 and 3, the biasing device 48 comprises the carrier arms 46,47, which carrier arms are both provided in the form of a resilient carrier arm, in particular in the form of a carrier arm comprising a spring blade. In addition, the combination of alignment arm 49 and damping element 52 also functions as a biasing device, which resiliently forces the frame towards a predetermined position. Thus, the alignment arm and dampening elements provide additional biasing to the biasing already is provided by the blade springs 46,47. Thus, in the embodiment shown in FIGS. 6-10, the biasing device is integrated in the spring blades that form the carrier arms 46,47 and the alignment arm 49 and damping element 52. Due to their resilient properties, the spring blades and cylinders resiliently force the frame, and thus the booster wheels supported by that frame, towards the predetermined position.

In an alternative embodiment, the carrier arms are non-resilient carrier arms, for example stiff arms hingeably connected at frame and base, and the alignment arm and damping elements form the biasing device.

It is observed that the booster drive motors are preferably provided in the form of high performance electric motors. Preferably, each booster drive motor drives a single drive wheel. Preferably, the booster drive is provided in the box like configuration which, when seen in top view, resembles a rectangle when the frame is its initial position, and resembles a parallelogram when the frame is moved in a lateral direction, with the booster drive motors mounted on the side of the frame facing the base. Thus, the base, the two carrier arms and the frame define an inner space, wherein the booster drives are provided, i.e. between the base and the frame and between the two carrier arms, to thus provide a compact booster drive. In such an embodiment, the distance between the base and the carrier is preferably at last 25 cm, preferably at least 27 cm, for example is 30 cm.

In a further embodiment according to the invention the amusement ride further comprises a vehicle control system for interfacing with the booster drive motors, or with motor controllers of the booster drives, provided along the vehicle track, and to thus control the speed of the booster drives, and thus the speed of the passenger vehicle while moving along the track.

It is observed that all booster drives disclosed herein can be combined with a vehicle track comprising a vehicle track structure that defines a support surface for supporting a passenger vehicle, and which vehicle track is configured for guiding one or more passenger vehicles provided with one or more drive fins along the vehicle track, to provide an amusement ride such as a roller coaster, according to the invention. The invention therefore also provides a booster drive for providing an amusement ride according to the invention.

The invention thus also provides a booster drive adapted to be mounted on a vehicle track to displace a passenger vehicle along that vehicle track, which vehicle is provided with a longitudinal drive fin for engagement by the booster drive, and which vehicle track comprises a vehicle track structure that defines a support surface for supporting the passenger vehicle and is configured for guiding the passenger vehicle along the vehicle track.

A booster drive according to the invention works with known drive fins, which are used in the prior art to provide a tractive surface on passenger vehicles to enable propulsion of the vehicles by engagement of the drive fin by booster drives. The booster drive according to the invention comprises a pinch drive system, in which two booster drive wheels having a wheel rim with a tractive surface for engaging the tractive surface of the drive fin, engage the drive fin between them. Furthermore, when the booster drive wheels are both supported by the frame, the distance between the wheels will not change when the frame is moved relative to the track, thus, their pinching force is maintained while moving in the lateral direction.

The booster drives according to the invention are especially suitable for combination with amusement rides of the coaster track type, having a vehicle track comprising conventional pair of parallel, spaced apart load bearing rails positioned above a base or backbone by a plurality of spaced apart rail supports and connected by ties. In particular, the booster drives according to the invention are especially suitable for us in curved sections of the track of such an amusement ride. The invention furthermore allows for a compact configuration of the booster drives, and thus for mounting them to a tie of the vehicle track A booster drive according to the invention allows to support the drives such that they can move in a direction substantially perpendicular to the track and not, or not substantially, in a direction of movement of the vehicle, i.e. the direction the passenger vehicle travels along the track. In other words, when the booster wheels are moved in the lateral direction, they are moved along a substantially linear trajectory and not along a substantially curved trajectory, as would be the case when mounted on pivotable support. Thus the invention allows for an efficient transfer of power between booster drive and passenger vehicle. Preferably, the booster drive is mounted with the frame upstream of the base, when seen in the direction of travel of the passenger vehicle along the track, such that the carrier arms are loaded under tension when propelling the passenger vehicle along the track.

The combination of lateral movement of the booster drive wheels, or better of the nip for receiving the drive fin defined by the booster drive wheels, in combination with a compact configuration of the booster drive allows for locating the booster drives in curved track sections.

Furthermore, because of these additional booster drives along the track, large lift hills are no longer necessary. Therefore, the amount of track can be reduced, producing a smaller track footprint which reduces costs. The invention thus allows for an efficient, high performance, electric powered amusement ride comprising one or more passenger vehicles propelled along a vehicle track.

The invention provides a booster drive of which the booster drive wheels, more in particular the nip defined by the booster drive wheels for receiving the drive fin, can adjust by lateral movement for an off center position of a drive fin of a passing passenger vehicle. Thus, wear of vehicle wheels, which may cause the drive fin to be no longer positioned at the center of the track, less quickly causes problems with the interaction between the drive fin of the vehicle and the booster drives mounted along the track. Furthermore, the flexibility of the booster drives, more in particular the flexible mounted booster drive wheels, facilitates mounting the booster drives in the track, since the position of the of the nip defined by the booster wheels relative to the track is less critical.

Also, as mentioned before, the booster wheels can adapt to position changes of the drive fin while the drive fin is engaged between the booster wheels, and can thus be mounted in curved sections of the vehicle track. Providing booster drives in curved sections of the vehicle track allows for a better control of the vehicle speed along the track, and thus for providing passengers of the passenger vehicle an enhanced thrill compared to the thrill experienced on a roller coaster type amusement ride provided with conventional booster drives, which are mounted along the straight sections of the track only.

Preferably, a booster drive according to the invention is configured such that it can be mounted and demounted from the vehicle track as a single unit, i.e. the base is releasable mounted to the track structure, and the booster drive can be removed by disengaging the base from the track structure. Thus, the invention provides a method for mounting a booster drive to a vehicle track, for providing an amusement ride according to the invention, by mounting the base of the booster drive according to the invention to the vehicle track.

It is furthermore noted that although the carrier arms of for example the embodiment shown in FIGS. 2 and 3 each comprise a single spring blade, alternative configurations, in which each carrier arm comprises multiple resilient elements are also possible. For example, a single carrier arm can comprise multiple spring blades or parallel resilient elements that together form a resilient carrier arm that functions similar to carrier arms shown FIGS. 2 and 2. Other configurations are also possible.

The invention claimed is:

1. An amusement ride, comprising:

a vehicle track, the vehicle track comprising a vehicle track structure that defines a support surface for supporting a passenger vehicle and being configured for guiding the passenger vehicle along the vehicle track;

at least one passenger vehicle, the passenger vehicle being provided with a longitudinal drive fin for engagement by a booster drive; and multiple booster drives mounted on the vehicle track to displace the passenger vehicle along the vehicle track, each of the multiple booster drives comprising:

two booster wheels, the two booster wheels being configured for each engaging a side of the longitudinal fin mounted on the passenger vehicle such that the fin is pinched between the booster wheels and the vehicle can be displaced along the vehicle track by driving one or both booster wheels;

at least one booster drive motor, the at least one booster drive motor being configured to drive at least one of the two booster wheels;

a base, the base having a left side and a right side and being is mounted to the vehicle track structure;

a frame, the frame having a left side and a right side and supporting the at least one booster drive motor and the two booster wheels; and a mobile carrier, the mobile carrier connecting the frame to the base and having at least one left carrier arm connecting the left side of the base to the left side of the frame and at least one right carrier arm connecting the right side of the base to the right side of the frame, the carrier arms being flexible arms or being pivotably connected to the base or the frame, such that in use the carrier arms enable movement of the frame relative to the base in a direction substantially parallel to the support surface defined by the vehicle track while preventing substantial movement in a direction perpendicular to said support surface, wherein the at least one left carrier arm and the at least one right carrier arm each are flexible arms, the flexible arms having their ends fixed to the base and the frame, such that the displacement of the frame relative to the base is achieved by flexing of the arms, wherein the at least one left carrier arm and the at least one right carrier arm are resilient carrier arms, such that the carrier arms, and thus the frame supporting the booster wheels, are resiliently forced towards the predetermined position, wherein the booster drive is mounted to the vehicle track such that the booster wheels are positioned for pinching the longitudinal drive fin of the passenger vehicle therebetween when the longitudinal drive fin passes the booster drive, and the mobile carrier of the booster drive allows for lateral movement of the longitudinal drive fin relative to the base of the booster drive, while the longitudinal drive fin is pinched between the booster wheels.

2. The amusement ride according to claim 1, wherein the at least one booster drive motor of the multiple booster drives is provided at a side of the frame facing the base, and between the at least one left carrier arm and the at least one right carrier arm.

3. The amusement ride according to claim 2, wherein the base, the frame and the carrier arms of the mobile carrier of the multiple booster drives are dimensioned such that they provide a box like configuration, the box having four walls defined by the base, the frame and the mobile carrier, the box comprising the at least one booster drive motor to thus provide a compact booster drive.

4. The amusement ride according to claim 1, wherein the booster drive comprises two booster drive motors and the position of at least one of the booster drive motors can be adjusted relative to the frame in a direction substantially perpendicular to a direction of travel of a passenger vehicle passing the booster drive, such that the wheels can be moved towards or away from each other to compensate for wear of the wheels.

5. The amusement ride according to claim 1, wherein the at least one left carrier arm and the at least one right carrier arm each comprise at least one spring blade, the spring blades being each with one end connected to the base and with an opposite end to the frame, and which spring blades are substantially parallel to each other and to a direction of travel of a passenger vehicle passing the booster drive, and substantially perpendicular to the support surface defined by the vehicle track.

6. The amusement ride according to claim 1, wherein the multiple booster drives each comprise two booster drive motors, and wherein each booster drive motor is configured to drive one of the booster wheels.

7. The amusement ride according to claim 6, wherein the frame of the multiple booster drives comprises:

a left support part, having a left side and a right side, the left support part supporting one of the two drive motors; and a right support part, having a left side and a right side, the right support part supporting the other of the two drive motors, and wherein the left support part and the right support part are adjustable connected, such that the right side of the left support part faces the left side of the right support part, and such that the distance between the left support part and the right support part, and thus the distance between the booster wheels, can be adjusted.

8. The amusement ride according to claim 7, wherein the mobile carrier further comprises at least one left centre carrier arm connecting the right side of the left support part with a centre area of the base and at least one right centre carrier arm connecting the left side of the right support part with the centre area of the base, the at least one left centre carrier arm and at least one right centre carrier arm being flexible or being pivotably connected to the base or the left support part and the right support part respectively, such that they enable movement of the left support part and the right support part relative to the base in a direction substantially parallel to the support surface defined by the vehicle track while preventing substantial movement in a direction perpendicular to said support surface, and wherein the booster drive motors are provided at the side of the frame facing the base and between the at least one left carrier arm and the at least one right carrier arm.

9. The amusement ride according to claim 1, further comprising a vehicle control system for interfacing with motor controllers of the booster drives provided along the vehicle track, and to thus control the drive speed of the booster drives, and thus the speed of the at least one passenger vehicle while moving along the track.

10. A booster drive adapted to be mounted on a vehicle track of an amusement ride for providing the amusement ride according to claim 1.

11. A method for mounting a booster drive to a vehicle track for providing the amusement ride according to claim 1.

12. A method for replacing a booster drive of the amusement ride according to claim 1.

13. The amusement ride according to claim 12, wherein the biasing device comprises resilient elements coupled with the at least one left carrier arm and/or the at least one right carrier arm, to force the carrier arms, and thus the frame supporting the booster wheels, towards the predetermined position.

14. An amusement ride, comprising:

a vehicle track, the vehicle track comprising a vehicle track structure that defines a support surface for supporting a passenger vehicle and being configured for guiding the passenger vehicle along the vehicle track;

at least one passenger vehicle, the passenger vehicle being provided with a longitudinal drive fin for engagement by a booster drive; and multiple booster drives mounted on the vehicle track to displace the passenger vehicle along the vehicle track, each of the multiple booster drives comprising:

two booster wheels, the two booster wheels being configured for each engaging a side of the longitudinal fin mounted on the passenger vehicle such that the fin is pinched between the booster wheels and the vehicle can be displaced along the vehicle track by driving one or both booster wheels;

at least one booster drive motor, the at least one booster drive motor being configured to drive at least one of the two booster wheels;

a base, the base having a left side and a right side and being is mounted to the vehicle track structure;

a frame, the frame having a left side and a right side and supporting the at least one booster drive motor and the two booster wheels;

a mobile carrier, the mobile carrier connecting the frame to the base and having at least one left carrier arm connecting the left side of the base to the left side of the frame and at least one right carrier arm connecting the right side of the base to the right side of the frame, the carrier arms being flexible arms or being pivotably connected to the base or the frame, such that in use the carrier arms enable movement of the frame relative to the base in a direction substantially parallel to the support surface defined by the vehicle track while preventing substantial movement in a direction perpendicular to said support surface; and a biasing device, the biasing device resiliently forcing the frame towards a predetermined position, wherein the biasing device comprises at least one of the carrier arms, the at least one carrier arm being provided in the form of a resilient carrier arm, such that the carrier arm, and thus the frame supporting the booster wheels, is resiliently forced towards the predetermined position, wherein the booster drive is mounted to the vehicle track such that the booster wheels are positioned for pinching the longitudinal drive fin of the passenger vehicle therebetween when the longitudinal drive fin passes the booster drive, and the mobile carrier of the booster drive allows for lateral movement of the longitudinal drive fin relative to the base of the booster drive, while the longitudinal drive fin is pinched between the booster wheels.

15. An amusement ride, comprising:

a vehicle track, the vehicle track comprising a vehicle track structure that defines a support surface for supporting a passenger vehicle and being configured for guiding the passenger vehicle along the vehicle track;

at least one passenger vehicle, the passenger vehicle being provided with a longitudinal drive fin for engagement by a booster drive; and multiple booster drives mounted on the vehicle track to displace the passenger vehicle along the vehicle track, each of the multiple booster drives comprising:

two booster wheels, the two booster wheels being configured for each engaging a side of the longitudinal fin mounted on the passenger vehicle such that the fin is pinched between the booster wheels and the vehicle can be displaced along the vehicle track by driving one or both booster wheels;

at least one booster drive motor, the at least one booster drive motor being configured to drive at least one of the two booster wheels;

a base, the base having a left side and a right side and being is mounted to the vehicle track structure;

a frame, the frame having a left side and a right side and supporting the at least one booster drive motor and the two booster wheels;

a mobile carrier, the mobile carrier connecting the frame to the base and having at least one left carrier arm connecting the left side of the base to the left side of the frame and at least one right carrier arm connecting the right side of the base to the right side of the frame, the carrier arms being flexible arms or being pivotably connected to the base or the frame, such that in use the carrier arms enable movement of the frame relative to the base in a direction substantially parallel to the support surface defined by the vehicle track while preventing substantial movement in a direction perpendicular to said support surface; and a biasing device, the biasing device resiliently forcing the frame towards a predetermined position, wherein the biasing device comprises at least one alignment arm, the alignment arm being a stiff arm that extends between the base and the frame, and the alignment arm being at a first end fixed to either the frame or the base, an opposite second end of the at least one alignment arm being provided with damping elements on respectively the base or the frame, the damping elements forcing the at least one alignment arm towards a predetermined position, and wherein the first end of the alignment arm is fixed to either the frame or the base and respectively the base or frame is provided with a bracket that passes through an opening provided in the second end of the alignment arm, such that respectively the alignment arm will rest on the bracket or the bracket will rest on the alignment arm when one or more of the carrier arms are removed, wherein the booster drive is mounted to the vehicle track such that the booster wheels are positioned for pinching the longitudinal drive fin of the passenger vehicle therebetween when the longitudinal drive fin passes the booster drive, and the mobile carrier of the booster drive allows for lateral movement of the longitudinal drive fin relative to the base of the booster drive, while the longitudinal drive fin is pinched between the booster wheels.

16. An amusement ride, comprising:

a vehicle track, the vehicle track comprising a vehicle track structure that defines a support surface for supporting a passenger vehicle and being configured for guiding the passenger vehicle along the vehicle track;

at least one passenger vehicle, the passenger vehicle being provided with a longitudinal drive fin for engagement by a booster drive; and multiple booster drives mounted on the vehicle track to displace the passenger vehicle along the vehicle track, each of the multiple booster drives comprising:

two booster wheels, the two booster wheels being configured for each engaging a side of the longitudinal fin mounted on the passenger vehicle such that the fin is pinched between the booster wheels and the vehicle can be displaced along the vehicle track by driving one or both booster wheels;

two booster drive motors, wherein each booster drive motor is configured to drive one of the two booster wheels;

a base, the base having a left side and a right side and being is mounted to the vehicle track structure;

a frame, the frame having a left side and a right side and supporting the at least one booster drive motor and the two booster wheels, wherein the frame of the multiple booster drives comprises:

a left support part, having a left side and a right side, the left support part supporting one of the two drive motors; and a right support part, having a left side and a right side, the right support part supporting the other of the two drive motors, and wherein the left support part and the right support part are adjustable connected, such that the right side of the left support part faces the left side of the right support part, and such that the distance between the left support part and the right support part, and thus the distance between the booster wheels, can be adjusted;

a mobile carrier, the mobile carrier connecting the frame to the base and having at least one left carrier arm connecting the left side of the base to the left side of the frame and at least one right carrier arm connecting the right side of the base to the right side of the frame, the carrier arms being flexible arms or being pivotably connected to the base or the frame, such that in use the carrier arms enable movement of the frame relative to the base in a direction substantially parallel to the support surface defined by the vehicle track while preventing substantial movement in a direction perpendicular to said support surface; and a biasing device, the biasing device resiliently forcing the frame towards a predetermined position, wherein the booster drive is mounted to the vehicle track such that the booster wheels are positioned for pinching the longitudinal drive fin of the passenger vehicle therebetween when the longitudinal drive fin passes the booster drive, and the mobile carrier of the booster drive allows for lateral movement of the longitudinal drive fin relative to the base of the booster drive, while the longitudinal drive fin is pinched between the booster wheels.

17. The amusement ride according to claim 16, wherein the mobile carrier further comprises at least one left centre carrier arm connecting the right side of the left support part with a centre area of the base and at least one right centre carrier arm connecting the left side of the right support part with the centre area of the base, the at least one left centre carrier arm and at least one right centre carrier arm being flexible or being pivotably connected to the base or the left support part and the right support part respectively, such that they enable movement of the left support part and the right support part relative to the base in a direction substantially parallel to the support surface defined by the vehicle track while preventing substantial movement in a direction perpendicular to said support surface, and wherein the booster drive motors are provided at the side of the frame facing the base and between the at least one left carrier arm and the at least one right carrier arm.

18. A booster drive mounting assembly, comprising a base, a frame, a mobile carrier and a biasing device, the mounting assembly being configured for mounting two booster drive motors on a vehicle track for providing the amusement ride according to claim 16.

19. An amusement ride, comprising:

a vehicle track, the vehicle track comprising a vehicle track structure that defines a support surface for supporting a passenger vehicle and being configured for guiding the passenger vehicle along the vehicle track;

at least one passenger vehicle, the passenger vehicle being provided with a longitudinal drive fin for engagement by a booster drive;

multiple booster drives mounted on the vehicle track to displace the passenger vehicle along the vehicle track, each of the multiple booster drives comprising:

two booster wheels, the two booster wheels being configured for each engaging a side of the longitudinal fin mounted on the passenger vehicle such that the fin is pinched between the booster wheels and the vehicle can be displaced along the vehicle track by driving one or both booster wheels;

at least one booster drive motor, the at least one booster drive motor being configured to drive at least one of the two booster wheels;

a base, the base having a left side and a right side and being is mounted to the vehicle track structure;

a frame, the frame having a left side and a right side and supporting the at least one booster drive motor and the two booster wheels;

a mobile carrier, the mobile carrier connecting the frame to the base and having at least one left carrier arm connecting the left side of the base to the left side of the frame and at least one right carrier arm connecting the right side of the base to the right side of the frame, the carrier arms being flexible arms or being pivotably connected to the base or the frame, such that in use the carrier arms enable movement of the frame relative to the base in a direction substantially parallel to the support surface defined by the vehicle track while preventing substantial movement in a direction perpendicular to said support surface; and a biasing device, the biasing device resiliently forcing the frame towards a predetermined position, and a motor controller; and a vehicle control system for interfacing with motor controllers of the booster drives provided along the vehicle track, and to thus control the drive speed of the booster drives, and thus the speed of the at least one passenger vehicle while moving along the track, wherein the booster drive is mounted to the vehicle track such that the booster wheels are positioned for pinching the longitudinal drive fin of the passenger vehicle therebetween when the longitudinal drive fin passes the booster drive, and the mobile carrier of the booster drive allows for lateral movement of the longitudinal drive fin relative to the base of the booster drive, while the longitudinal drive fin is pinched between the booster wheels.

* * * * *